US011549297B2

(12) United States Patent
Giovannetti

(10) Patent No.: US 11,549,297 B2
(45) Date of Patent: Jan. 10, 2023

(54) MECHANISM FOR MOVING A FURNITURE DOOR

(71) Applicant: DONGTAI HARDWARE PRECISION (HONG KONG) LIMITED, Hong Kong (HK)

(72) Inventor: Antonio Giovannetti, Segrate Milan (IT)

(73) Assignee: DONGTAI HARDWARE PRECISION (HONG KONG) LIMITED, New Territories (HK)

( * ) Notice: Subject to any disclaimer, the term of this patent is extended or adjusted under 35 U.S.C. 154(b) by 463 days.

(21) Appl. No.: 16/606,799

(22) PCT Filed: Mar. 13, 2018

(86) PCT No.: PCT/EP2018/056280
§ 371 (c)(1),
(2) Date: Oct. 21, 2019

(87) PCT Pub. No.: WO2018/192718
PCT Pub. Date: Oct. 25, 2018

(65) Prior Publication Data

US 2020/0040634 A1 Feb. 6, 2020

(30) Foreign Application Priority Data

Apr. 21, 2017 (IT) ..... 102017000044196

(51) Int. Cl.
*E05F 1/10* (2006.01)
*E05F 1/08* (2006.01)

(52) U.S. Cl.
CPC ..... *E05F 1/1058* (2013.01); *E05F 1/08* (2013.01); *E05Y 2900/20* (2013.01)

(58) Field of Classification Search
CPC ..... E05F 1/1058; E05F 1/1041; E05F 1/105; E05F 1/1066; E05F 1/1075; E05F 1/1246;
(Continued)

(56) References Cited

U.S. PATENT DOCUMENTS 3,950,819 A * 4/1976 Little ..... E05F 1/1058 16/85
7,178,202 B2 * 2/2007 Hirtsiefer ..... E05D 15/46 16/366

(Continued)

FOREIGN PATENT DOCUMENTS

DE 2106614 A1 8/1972
JP 2003-118467 A 4/2003

(Continued)

OTHER PUBLICATIONS

International Search Report (dated Apr. 12, 2018) for corresponding International App. PCT/EP2018/056280.

(Continued)

*Primary Examiner* — Jeffrey O'Brien
(74) *Attorney, Agent, or Firm* — WRB-IP LLP

(57) ABSTRACT

Mechanism for moving a furniture door, apt to be placed on a lateral side of the piece of furniture and to move a door by a system of levers, the mechanism comprising a spring unit acting on the system of levers to balance the weight force of the door during opening, wherein the spring unit is pivotally mounted and acts directly on a main or thrust lever, mounted rotating around an axis, by a pin housed in a first cam slot formed in the lever and in a second cam slot placed in a fixed position with respect to the lateral side of the piece of furniture.

9 Claims, 8 Drawing Sheets

(58) Field of Classification Search
CPC ..... E05F 1/1253; E05F 1/1261; E05F 1/1269; E05F 1/1276; E05F 1/08; E05Y 2900/20
See application file for complete search history.

(56) References Cited

U.S. PATENT DOCUMENTS

| | | | | |
|---|---|---|---|---|
| 8,443,489 | B2 * | 5/2013 | Sir Louis | E05F 3/20 16/306 |
| 9,009,917 | B2 * | 4/2015 | Chao | E05F 1/1091 16/72 |
| 9,464,473 | B2 * | 10/2016 | Baldreich | E05F 1/1058 |
| 10,633,904 | B2 * | 4/2020 | Elkasevic | F24C 15/023 |
| 11,168,502 | B2 * | 11/2021 | Oshima | E05F 1/1253 |
| 2003/0071047 | A1 * | 4/2003 | Harada | E05F 1/1075 220/827 |
| 2022/0034140 | A1 * | 2/2022 | Terenzi | E05F 1/1276 |
| 2022/0074248 | A1 * | 3/2022 | Holzapfel | E05D 3/16 |

FOREIGN PATENT DOCUMENTS

| | | | |
|---|---|---|---|
| JP | 2004-531661 | A | 10/2004 |
| JP | 2008-533342 | A | 8/2008 |
| JP | 2017-509814 | A | 4/2017 |

OTHER PUBLICATIONS

Japanese Official Action (dated Dec. 27, 2021) for corresponding Japanese App. 2020-507740.

* cited by examiner

MECHANISM FOR MOVING A FURNITURE DOOR

BACKGROUND AND SUMMARY

It is desirable to provide a mechanism for moving a door of an item of furniture, more particularly, but not exclusively, a door of an item of kitchen furniture with lift opening.

Remaining in the area of kitchen furniture, the lift opening doors can be of the so-called vertical, oblique, folding, flap with or without hinges opening type, as will be made clearer here below, according to the arrangement and configuration of the levers of movement of the door, which normally comprise a main lever or thrust lever and a secondary accompaniment lever.

Various spring mechanisms are available commercially which assist during lifting of the door and keep it in position of total or partial opening, opposing the weight force of the same.

Known mechanisms have complicated motion systems and drives in order to go to act on the main or thrust lever of the door, in order to maintain it in equilibrium in the various positions, and are therefore found to be costly.

Additionally, the spring pack of these mechanisms has to be set up and calibrated for every particular application, interchangeability of the spring pack on the basis of the dimensions and of the weight of the door not being normally possible.

It is desirable to eliminate disadvantages of known systems.

More particularly, it is desirable to provide a mechanism for moving a door of an item of furniture which has a reduced number of components and which is therefore simple and economical to produce and which is at the same time highly reliable.

It is also desirable to provide such a movement mechanism which can be used, without substantial changes, for doors with vertical opening, with oblique opening, with folding opening, with flap opening with or without hinges.

It is also desirable to provide such a mechanism which, aside from the type of opening of the door, can be fixed always in the same position on a lateral side of the item of furniture.

It is also desirable to provide the possibility of interchanging the spring pack as a function of the weight of the door.

A mechanism for moving a door of an item of furniture is provided according to an aspect of the invention.

Advantageous embodiments of the invention will be disclosed in the dependent claims.

Substantially, the mechanism for moving a furniture door, according to an aspect of the invention, apt to be placed on a lateral side of the furniture item and to move a door by means of a system of levers, comprises a spring unit acting on said system of levers in order to balance the weight force of the door during opening, wherein said spring unit is pivotally mounted and acts directly on a main or thrust lever, mounted rotating around an axis, by means of a pin housed in a first cam slot formed in the lever and in a second cam slot placed in a fixed position with respect to the lateral side of the furniture item.

BRIEF SUMMARY OF THE DRAWINGS

Further features of aspects of the invention will be made clearer by the following detailed description, referred to one of its embodiments purely by way of a non-limiting example, illustrated in the accompanying drawings, in which.

DETAILED DESCRIPTION

Figure 1C:
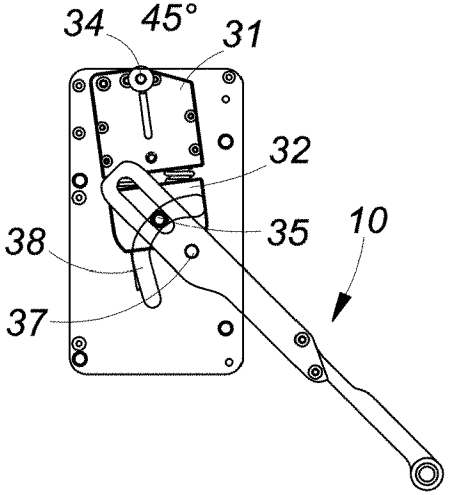
FIGS. 1*a* to 1*f* show schematically, in plan views, the positions which the device for moving a door according to the invention occupies, starting from complete closure to complete opening of the door.

Referring for the time being to one of FIGS. 2 to 6, to which reference may be made here below again if necessary, they illustrate an item of kitchen furniture, denoted overall by reference numeral 1, comprising a fixed frame made up of a lower shelf or wall 2, an upper shelf or wall 3, two side walls or lateral sides 4, one of which removed to show the device according to the invention, denoted by reference numeral 100, and a possible back wall 5. The item of furniture 1 has frontally a door 6, which in the case in question is of the lift type and, in lowered position, closes an internal compartment 7 of the furniture item.

The movement mechanism 100, as will be made clearer here below, comprises a main or thrust lever 10 and a secondary lever 20, the configuration and arrangement whereof determine the different modes of opening of the door 6, as will be mentioned briefly here below.

The main or thrust lever 10 serves to balance the weight force of the door 6 in each position during the phase of opening.

Referring now to FIG. 1, a description will be given of the principle of functioning of the mechanism for moving a door according to the invention, the structure whereof will be illustrated in greater detail with reference to FIGS. 7-11.

The mechanism 100 comprises elastic means, constituted by a spring unit which, in the embodiments illustrated, comprises two springs 30 acting in compression between a body 31 and a slider 32, sliding on a pair of posts or rods 33, whereon the springs 30 are mounted.

The body 31 is mounted so as to be able to pivot around a pin 34, while the slider 32 carries a pin 35 inserted in a slot 36, which in the embodiments illustrated is of the linear type, formed in the main lever 10.

In the accompanying drawings the lever 10 is shown in two parts 10', 10", rigidly connected one to the other, but could obviously be made in a single part.

The lever 10 is pivoted on a pin 37 and its rotation around the pin 37 is permitted by the sliding of the pin 35 of the slider 32 in the slot 36, under the action of the spring unit 30 which, according to the angular position of the lever 10, assists or contrasts the rotation of the same, pivoting together with the body 31 around the suspension pin 34.

Figure 12:
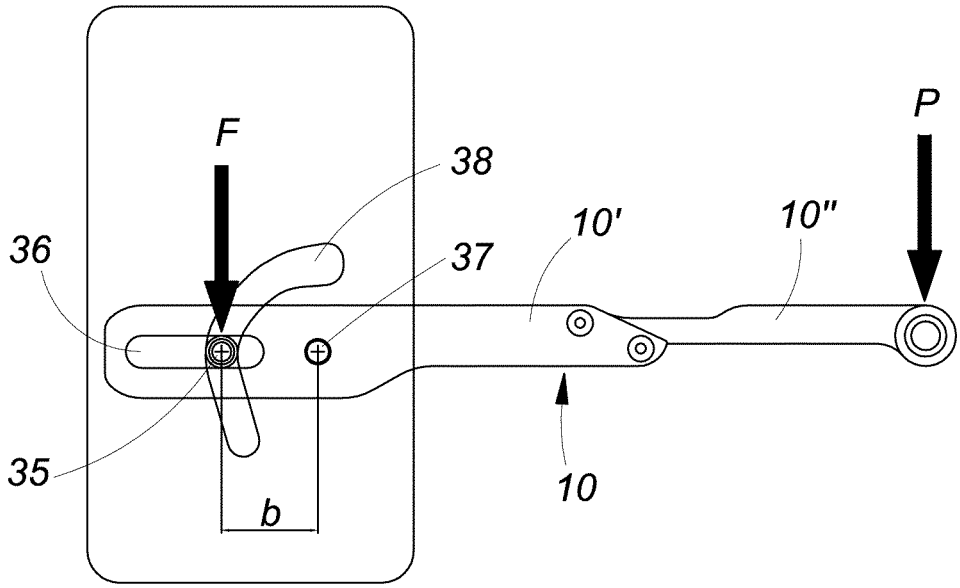
FIG. 12 is a view similar to FIG. 1*d*, showing the diagram of forces of the device.

The variation of the lever span, denoted by b in the diagram of forces of FIG. 12, where the arrows indicate the thrust force F of the spring and the weight force P of the door, is determined by a second slot 38 with curved profile, integral with the lateral side of the furniture item, wherein the pin 35 is also inserted.

The profile of the slot 38 allows therefore varying of the span b and the angle of thrust of the spring unit 30 on the main lever 10 and thus generating of the exact moment on the latter, such as to balance the weight force P of the door.

The two slots 36, 38 therefore work as cams and can have different profiles from those shown, in particular the slot 36 formed on the main lever 10 could be non-linear, so as to be able to optimise the different types of opening of the door, which will be described in brief here below with reference to FIGS. 2 to 6. Likewise, the slot 38, integral with the lateral side of the furniture item, could have a linear rather than curved profile.

Returning to FIG. 1, a sequence of positions of the movement mechanism 100 is shown, placed in the upper part of a lateral side 4 of the frame of a furniture item during the opening of the door 6.

Figure 1B:
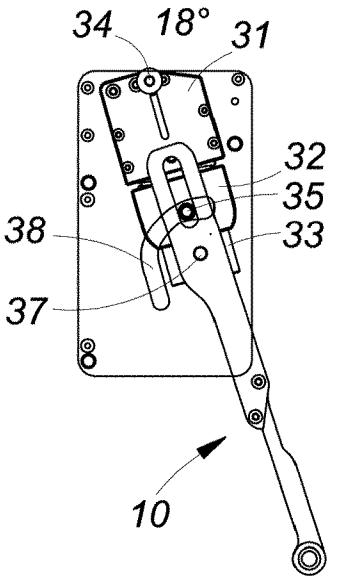
Figure 1A:
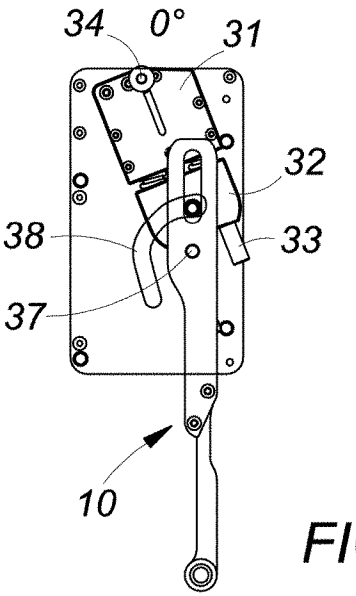

In FIG. 1*a*, corresponding to the position of complete closure of the door, the main lever 10 is oriented vertically at an angle which we will indicate as 0°. In this situation the spring unit 30 is oriented in such a direction as to exert a force which opposes the opening of the door, that is a rotation in anticlockwise direction of the main lever 10.

FIG. 1*b* shows the main lever 10 rotated in anticlockwise direction through an angle of 18° around the pivot 37, while the body 31, and with it the spring unit 30, is rotated slightly in clockwise direction around the pin 34. This position corresponds to a dead centre condition, wherein the spring unit 30 is in perfect alignment with the main lever 10, and does not exert any action, neither of thrust nor of resistance to the rotation of the lever 10.

Figure 1F:
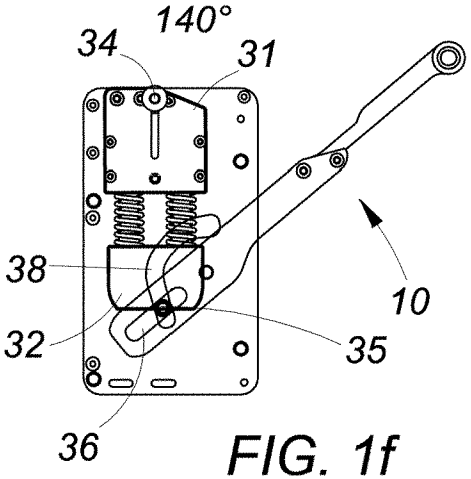
Figure 1E:
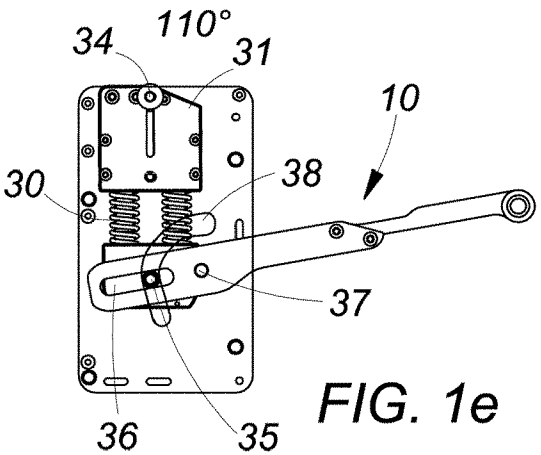
Figure 1D:
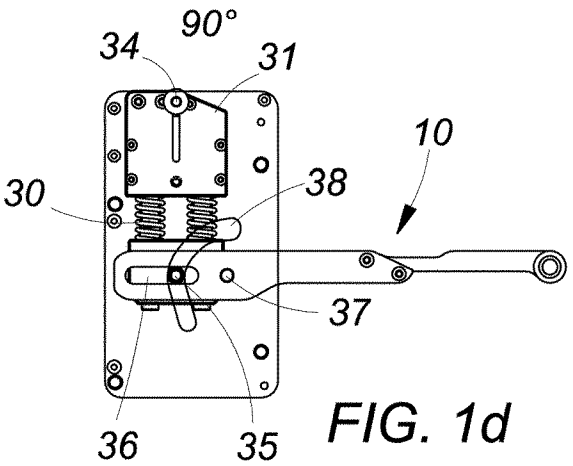

Having superseded the dead centre position of FIG. 1*b*, the lever span b determined by the force of the spring unit 30 starts to increase, offering an aid to lifting of the door, until arriving at the position of complete opening corresponding to an angle of 140° in the embodiment illustrated (FIG. 1*f*).

The variation in the thrust of the springs 30 is determined by the profile of the cam slot 38 provided in a fixed position with respect to the lateral side of the furniture item.

In the reverse operation of closure of the door the opposite occurs. Starting from the position of complete opening of FIG. 1*f*, the springs 30 put up a gradually decreasing resistance to the rotation in clockwise direction of the main lever 10, and therefore to the lowering of the door 6, as far as the dead centre position of FIG. 1*b*, after which they exert a positive thrust and therefore a return of the door into the position of closure shown in FIG. 1*a*.

Figure 7:
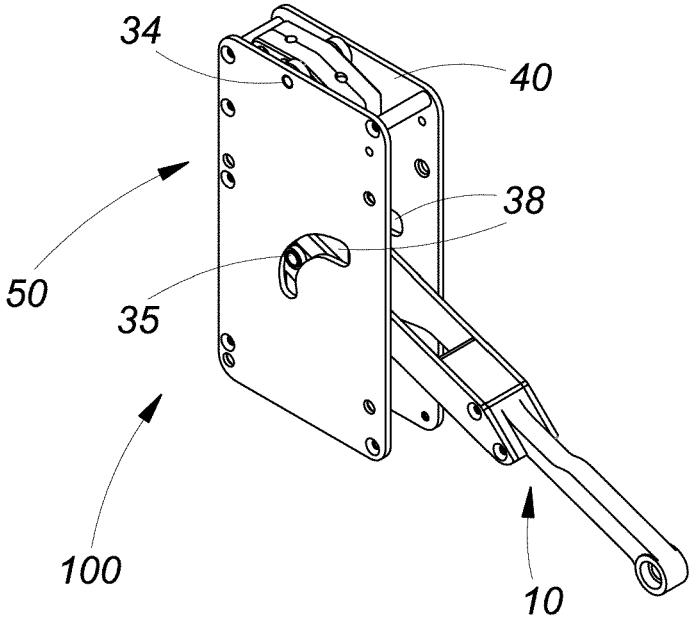
FIG. 7 is an axonometric view of a first embodiment of the device according to the invention shown in assembled condition.
Figure 8:
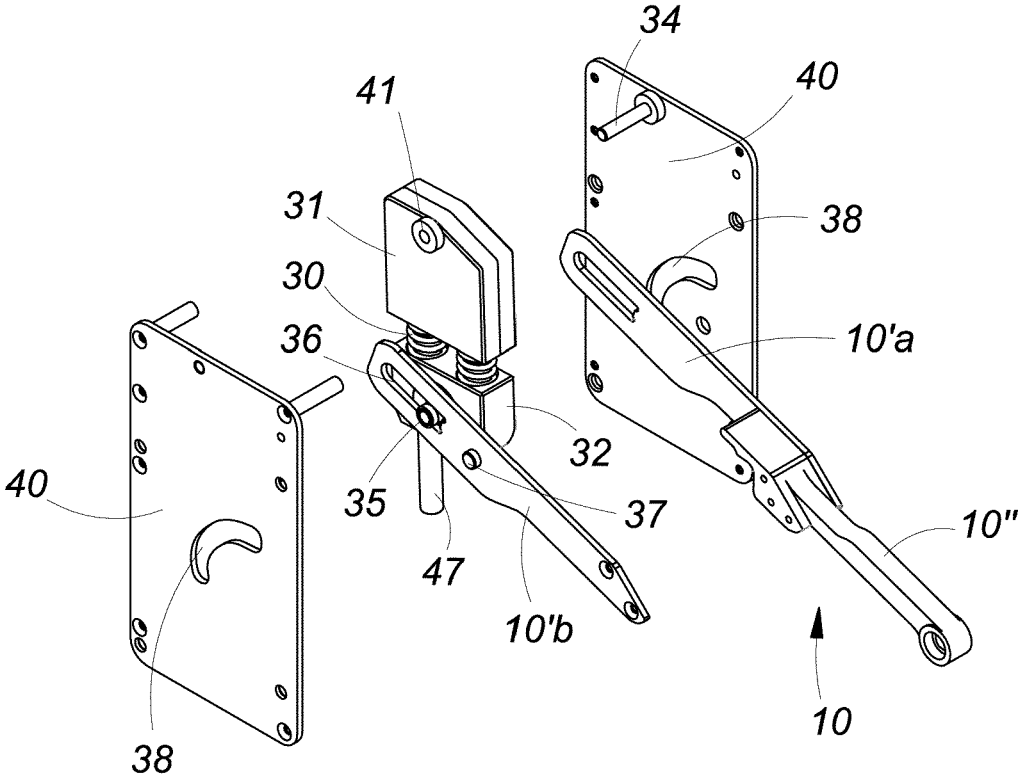
FIG. 8 is a blown-up view of the device of FIG. 7 showing the mode of assembly.

Referring now to FIGS. 7 and 8, a description is given in slightly greater detail of the structure of a first embodiment of the movement mechanism 100, using, as far as possible, the reference numerals already introduced in the description of the preceding drawings.

The main or thrust lever 10, that is its innermost part 10' in the embodiment in two parts made integral one with the other illustrated in the drawings, is in actual fact made in two parts adjacent one to the other 10'*a*, 10'*b* so as to enclose between them the slider 32 with the pin 35 inserted in the slot 36 formed in each of these parts.

The assembly constituted by the body 31, by the springs 30, by the slider 32 and by the main lever 10 is enclosed between a pair of opposing plates 40, in each of which a slot 38 is formed for the housing of the pin 35, so that, following assembly, a box 50 is formed with flattened parallelepiped shape, to be attached to a lateral side 4 of the furniture item, for example by means of screws which are inserted in an appropriate hole formed in the lateral side of the furniture item.

In the embodiment of FIGS. 7 and 8, the pin 35 housed in the cam slots 36, 38 is carried by the slider 32 against which the spring unit 30 acts, while the body 31 has a hole 41 for the insertion in the pivot pin 34.

During assembly the spring unit is kept slightly compressed by a stop 47 which is subsequently removed.

Such an embodiment does not allow a possible replacement of the spring unit.

Figure 9:
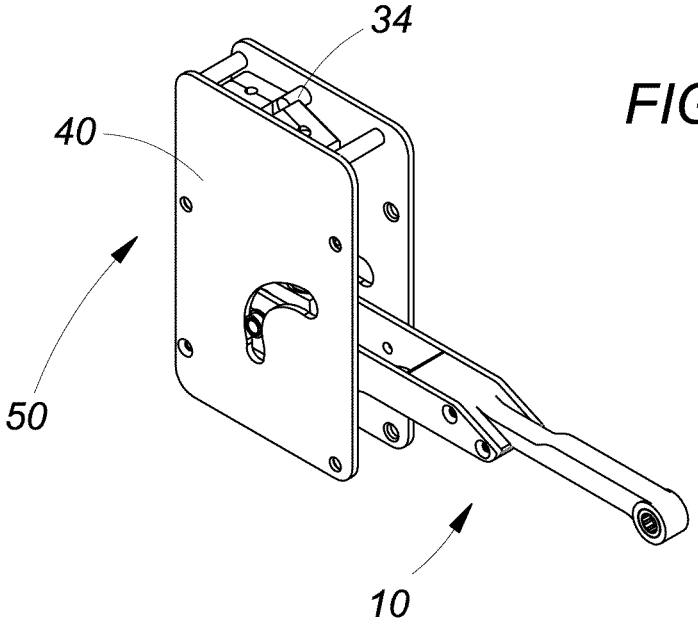
FIG. 9 is an axonometric view of the device according to the invention, shown assembled, in a second embodiment.
Figure 10C:
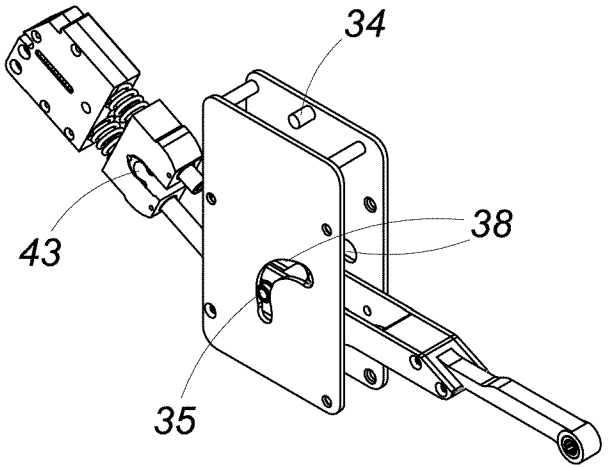
FIGS. 10*a, b, c* are axonometric views showing the assembly of the device of FIG. 9.
Figure 10B:
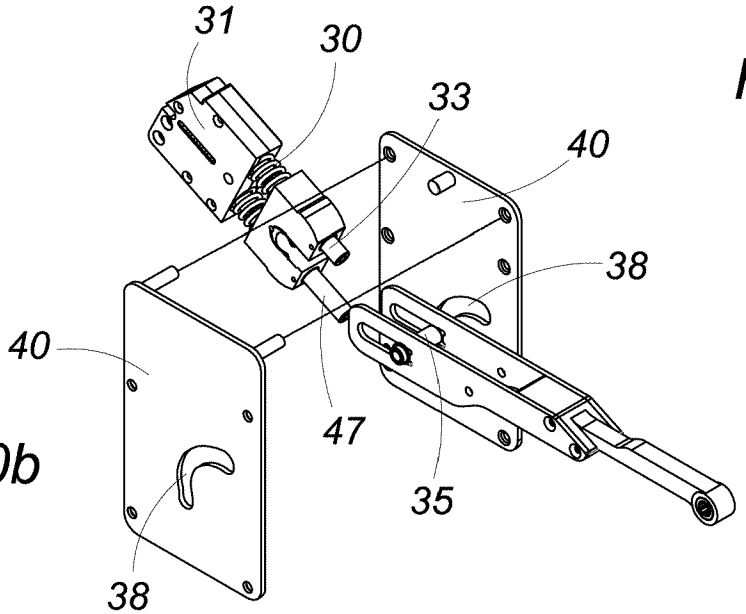

The embodiment shown in FIGS. 9 and 10 differs from the preceding one due to the fact it allows easy replacement of the spring unit 30 in order to adapt the device 100 to the weight of the door.

Figure 10A:
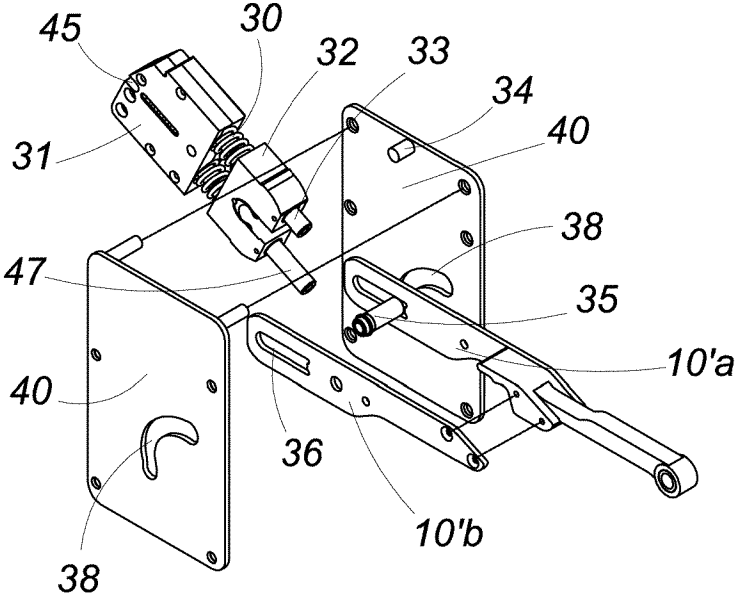

According to this embodiment the pin 35 is unrestrained from the slider 32 and is placed in the slots 36 and 38 between the two parts 10'*a* and 10'*b* of the main lever 10 and the two plates 40 in the assembly phase, as shown by FIGS. 10*a, b, c*.

The slider 32 has, on the side opposite to the springs 30, a notch with U shape 43, which is inserted in the pin 35.

A further U-shaped notch 45 is provided on the body 31, again on the side opposite to the springs 30, which goes instead to insert in the pivot pin 34.

The series of FIGS. 11*a* to 11*e* illustrates more clearly the sequence of assembly of the spring unit 30, kept slightly compressed between the body 31 and the slider 32 by a stop 47 placed on one of the posts 33 whereon the springs and the slider are mounted.

Figure 11A:
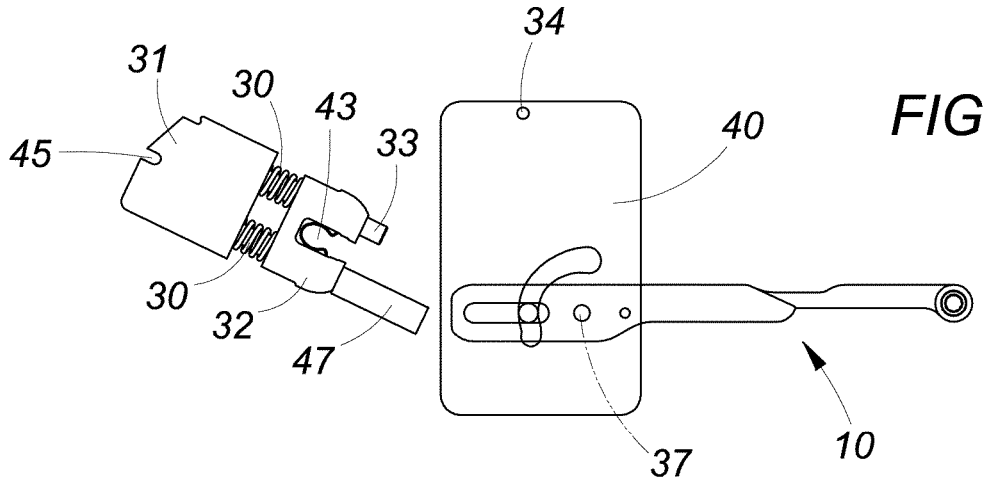
FIGS. 11*a, b, c, d,* and *e* are a succession of plan views showing the assembly of the device of FIG. 9.
Figure 11B:
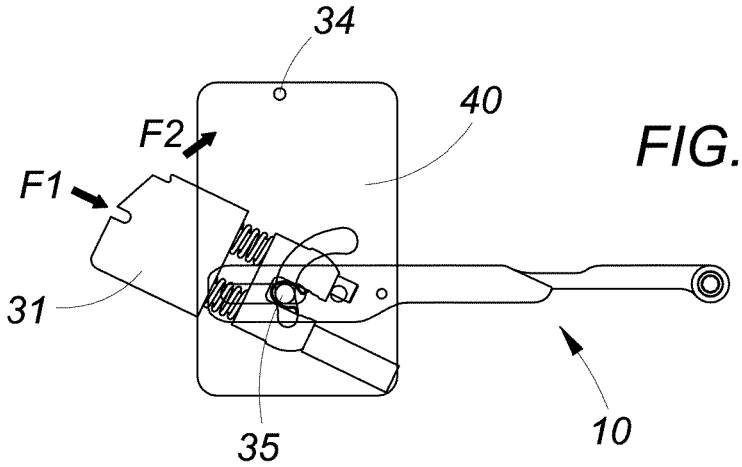
Figure 11C:
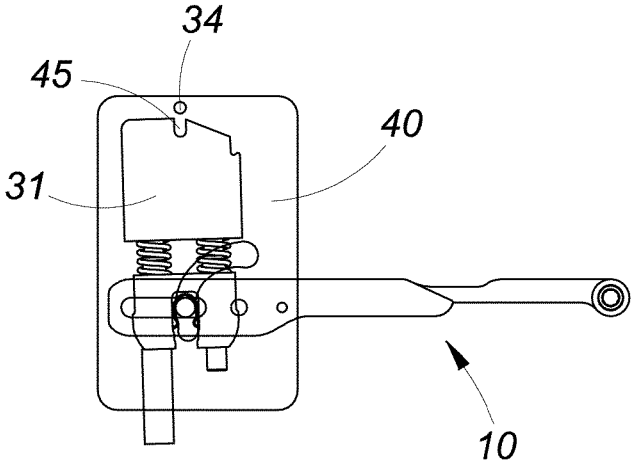

The spring unit is inserted between the plates 40, housing the pin 35 in the notch 43 of the slider 32, pushing the unit in the direction of the arrow F1 of FIG. 11*b*. Subsequently the unit is rotated in a clockwise direction, as indicated in the arrow F2, to take the notch 45 formed in the body 31 to the position of the pin 34 (FIG. 11*c*).

Figure 11D:
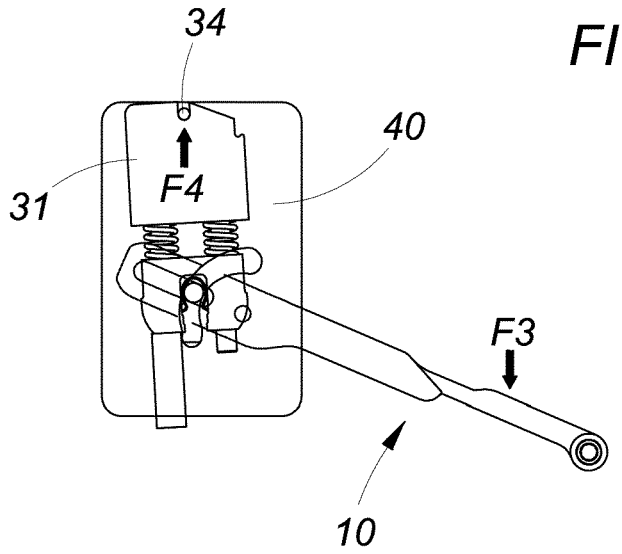
Figure 11E:
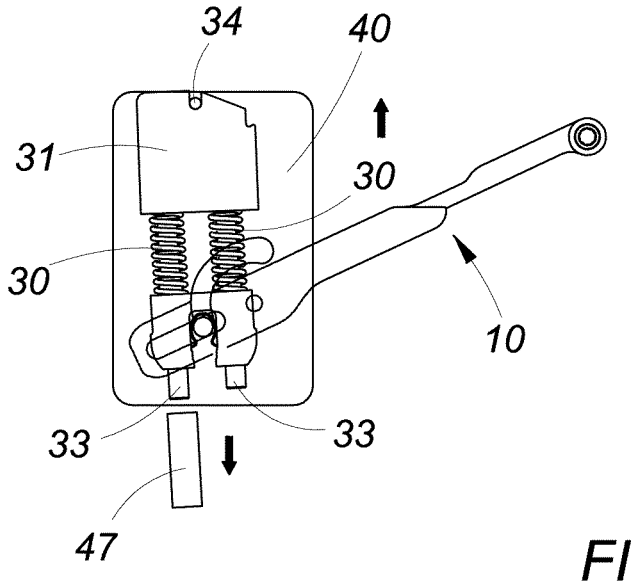

The lever is rotated downwards in clockwise direction, as indicated in the arrow F3 in FIG. 11*d*, causing a lifting of the body 31, as indicated by the arrow F4, with the consequent housing of the pin 34 in the notch 45.

Finally the spring stop 47 is removed, causing an expansion of the springs 30, with consequent rotation in anticlockwise direction of the lever 10.

Should the mechanism 100 according to the invention have to be adapted to a door of different weight, the spring unit can easily be replaced, performing the operations described previously in reverse order.

FIGS. 2 to 6 illustrate different types of movements of opening of the door 6, with the movement device 100 according to the invention, determined solely by the different configuration and arrangement of the main lever 10 and of the secondary lever 20.

Figure 2A:
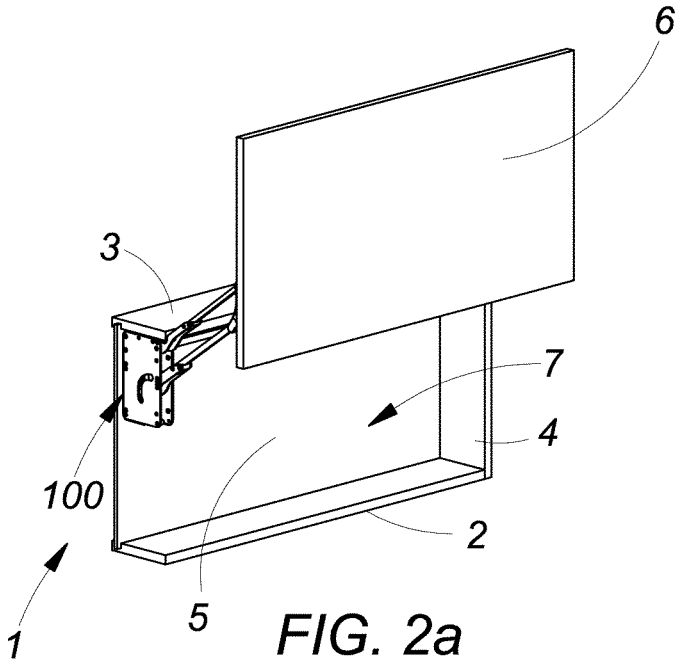
FIGS. 2*a, b* to 6*a, b* illustrate, in perspective view and in side profile view respectively, different types of opening of a door shown in open position.
Figure 2B:
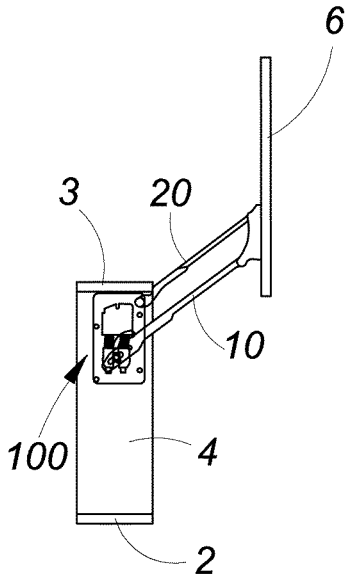

FIG. 2 illustrates a door with vertical opening, wherein the main lever 10 and the secondary lever 20, approximately parallel one to the other, form a sort of articulated parallelogram connecting the door 6 to the box 50.

Figure 3A:
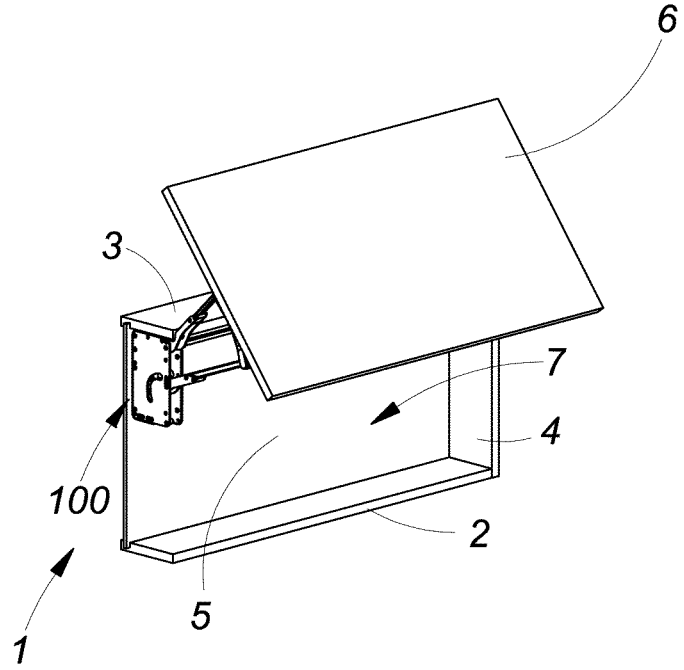
Figure 3B:
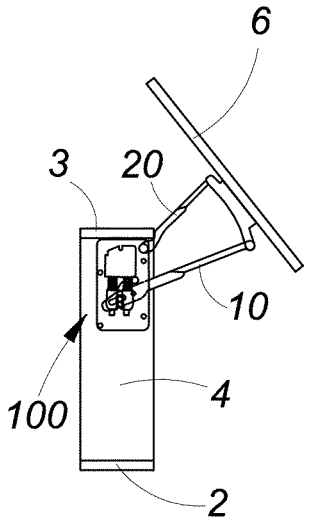

FIG. 3 shows a door with oblique opening which is arranged slanted with respect to the vertical line in open position. In this case the levers 10 and 20 which connect the door 6 to the box 50 of the device diverge in the direction of the door.

Figure 4A:
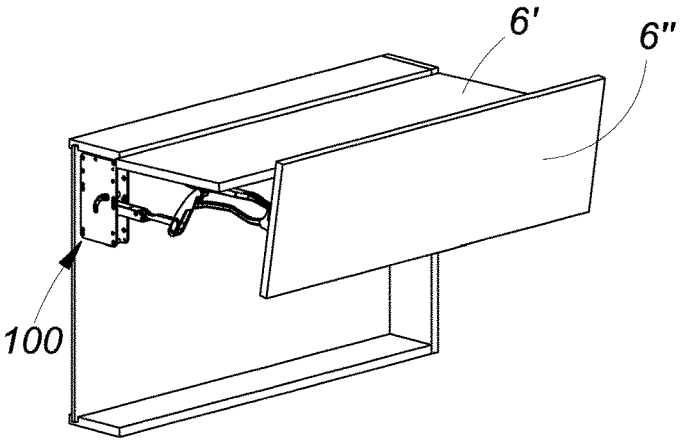
Figure 4B:
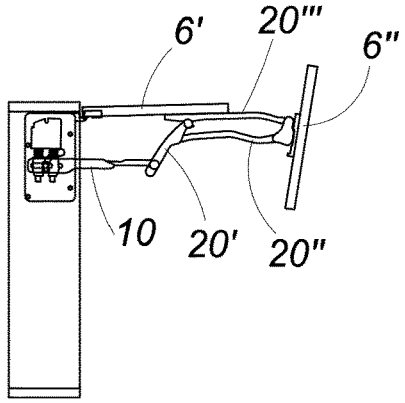

FIG. 4 shows a so-called folding opening, wherein the door 6 is divided into two half-doors 6', 6" and the main lever 10 acts on a system of secondary levers 20', 20", 20'" placed between the two half-doors.

Figure 5A:
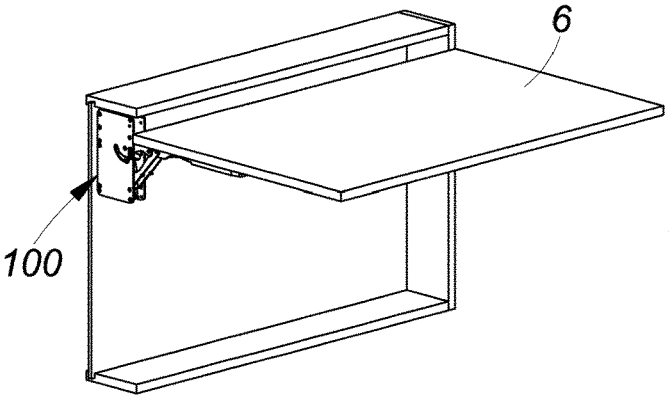
Figure 5B:
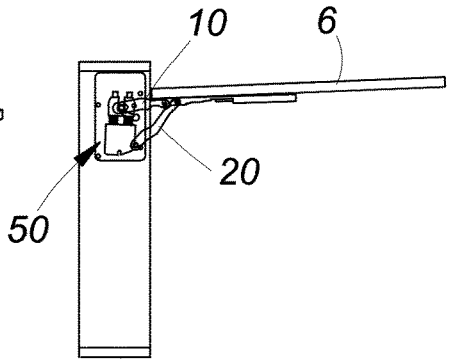

FIG. 5 illustrates a door with flap opening without hinges.

In this case the box 50 of the device 100 is mounted overturned with respect to the preceding cases and the main lever 10 and the secondary lever 20 have reversed position.

Figure 6A:
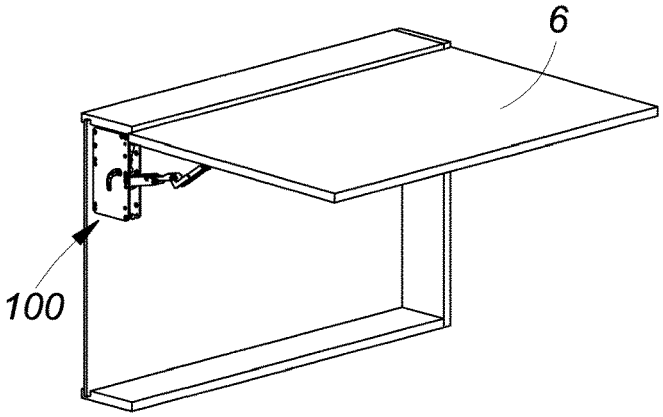
Figure 6B:
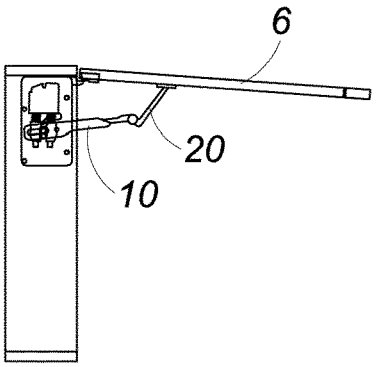

FIG. 6 shows a door with flap opening with hinges.

In this case the secondary lever 20 constitutes an extension of the main lever 10 with which it is articulated and the door 6 is hinged at the upper part of the frame of the furniture item.

For the movement of the door 6 a single device 100 can be provided, mounted on a lateral side of the furniture item or two devices mounted on both lateral sides The box 50 of the movement device according to the invention is attached on the lateral side 4 of the furniture item again through the same hole, aside from the type of opening of the door.

From what has been disclosed the advantages of the device for moving a furniture door according to the invention appear clear, which allows balancing of the weight of the door by acting with the spring unit directly on the main thrust lever by means of a pin inserted in a double cam slot.

Moreover, in an embodiment of the invention, the spring unit can be easily replaced as a function of the weight of the door.

Naturally the invention is not limited to the particular embodiments described previously and illustrated in the accompanying drawings, but numerous detail changes may be made thereto, within the reach of the person skilled in the art, without thereby departing from the scope of the same invention, defined by the appended claims.

The invention claimed is:

1. Mechanism for moving a furniture door, configured to be placed on a lateral side of a piece of furniture and to move a door by means of a system of levers, the mechanism comprising a spring unit acting on the system of levers in order to balance a weight force of the door during opening, wherein the spring unit comprises a first spring, wherein the spring unit is pivotally mounted and acts directly on a main lever, the main lever is mounted rotating around an axis, the spring unit acts on the main lever by means of a sliding pin housed in a first cam slot formed in the main lever and housed in a second cam slot formed in a first plate, wherein the first plate is placed in a fixed position with respect to the lateral side of the piece of furniture.

2. Mechanism according to claim 1, wherein the spring unit further comprises a body pivoted on a pivot pin and a slider constrained to the sliding pin, wherein the first spring is between the body and the slider.

3. Mechanism according to claim 2, wherein the spring unit comprises a second spring, wherein the first and second springs are placed on respective posts or rods on which the slider slides.

4. Mechanism according to claim 1, wherein the first cam slot formed in the main lever has a linear or curvilinear profile, and the second cam slot in the first plate has a curvilinear or linear profile.

5. Mechanism according to claim 2, wherein the main lever comprises first and second adjacent lever portions, each of the first and second lever portions provided with a respective first cam slot and embracing the slider, a second plate formed parallel to the first plate, each of the first and second plates provided with a respective second cam slot, the the pivot pin of the body being placed between the first and second plates.

6. Mechanism according to claim 5, wherein the sliding pin is integral to the slider and the body has a hole for insertion of the pivot pin.

7. Mechanism according to claim 5, wherein the sliding pin is constrained in the first cam slots of the first and second lever portions and in the second cam slots of the first and second plates, the slider having a notch for coupling on the sliding pin, and the body having a notch for coupling on the pivot pin.

8. Mechanism according to claim 1, further comprising a secondary lever, combined with the main lever, configured to form a vertical opening, an oblique opening, a folding opening, a flap opening without hinges, or a flap opening with hinges, of the door.

9. Piece of furniture comprising at least one mechanism according to claim 1, for moving a door.

* * * * *